US005634623A

United States Patent [19]

Hoijtink

[11] Patent Number: 5,634,623

[45] Date of Patent: Jun. 3, 1997

[54] FIXING DEVICE FOR A PUBLICATION

[76] Inventor: Albertus J. Hoijtink, Westerstraat 226 bg., NL-1015 MS Amsterdam, Netherlands

[21] Appl. No.: 190,091

[22] PCT Filed: Aug. 3, 1992

[86] PCT No.: PCT/NL92/00138

§ 371 Date: Feb. 1, 1994

§ 102(e) Date: Feb. 1, 1994

[87] PCT Pub. No.: WO93/02592

PCT Pub. Date: Feb. 18, 1993

[30] Foreign Application Priority Data

Aug. 1, 1991 [NL] Netherlands ..... 9101328

[51] Int. Cl.[6] ..... A47B 97/04

[52] U.S. Cl. ..... 248/448; 248/452; 248/453

[58] Field of Search ..... 248/448, 449, 248/451, 452, 453

[56] References Cited

U.S. PATENT DOCUMENTS

| | | | |
|---|---|---|---|
| 475,126 | 5/1892 | Lorenz | 248/453 |
| 483,244 | 9/1892 | Zavadil | 248/452 |
| 1,953,560 | 4/1934 | Johnson | 248/448 |
| 3,114,215 | 12/1963 | Turkin | 248/449 |
| 3,638,898 | 2/1972 | Shaw | 248/448 X |
| 4,275,863 | 6/1981 | Hartman | 248/448 |
| 4,318,527 | 3/1982 | Smith | 248/459 |
| 4,470,571 | 9/1984 | Hartman | 248/453 X |
| 4,502,657 | 3/1985 | Monfort | 248/451 |

FOREIGN PATENT DOCUMENTS

| | | | |
|---|---|---|---|
| 2602130 | 2/1988 | France . | |
| 563262 | 8/1944 | United Kingdom | 248/448 |

*Primary Examiner*—Korie Chan
*Attorney, Agent, or Firm*—Young & Thompson

[57] ABSTRACT

A device for holding a publication such as a book or a magazine, comprising two L-shaped supports slidable relative to each other and adapted to accommodate a publication between them. The supports having confronting surfaces between which the publication is held, these surfaces being covered with a flat brush secured to each of those surfaces. Each brush has a plurality of upstanding hairs adapted to engage between pages of a publication to be held. The hairs are inclined relative to the surfaces from which they upstand, in a direction opposite to the direction in which a page is initially turned.

7 Claims, 3 Drawing Sheets

FIXING DEVICE FOR A PUBLICATION

FIELD OF THE INVENTION

The present invention relates to a fixing device fop a publication, such as a book or a magazine, comprising two supports slidable relative to each other and accommodating the publication, which supports are covered with a deformable material holding the pages of the publication.

BACKGROUND OF THE INVENTION

Such a device is known from U.S. Pat. No. 1,953,560. During the reading of books, particularly in the case of handicapped people or when the person is lying down, there is always a need to hold the book or other publication open in the correct position without holding the book oneself. This applies in particular if a person is trying to read a book lying down, when it is then above or beside the reader's head.

In the abovementioned U.S. Pat. No. it is proposed that the deformable material should be a rubber spongy material. Such a readily deformable material will compress through the stiffness of the pages of the publications, and in this way all pages are held in place. All pages are in this case held by friction between the rubber-like material and the pages. Problems occur when a page has to be turned. At the place where the page is removed, the deformation will be only partially removed, while it is not possible to produce a further deformation at the place where a new page is placed, because a single page is not sufficiently stiff to do this.

It has been found that for limp, thin publications in particular insufficient friction is produced by the rubber material. Besides, the force is applied in particular to the part of the page which is close to the cover of the publications and against their middle part, so that there are always difficulties when turning over the page. This means that this fixing device is not able to support the book, i.e. keep it suspended in a position above the head. The object of the invention is to avoid this disadvantage.

SUMMARY OF THE INVENTION

This object is achieved in the case of a fixing device of the type described above in that the deformable material comprises a multiplicity of hairs, and the pages have to be confined between the hairs. The invention is based on the idea of no longer holding the pages in place through a frictional grip of a readily deformable material, but by using hairs to provide a positive locking of the pages, and in particular the pages near the open pages. A page will tilt the hairs slightly and slide along them when it is being turned over. When the hairs spring back the next page is blocked. The page added to a number of pages will also turn over the hairs and be blocked by the hairs springing back. The book is now no longer supported by the friction between the deformable material and the pages, but by the force which is necessary to tilt the hairs. Since it is still possible to provide a very large number of hairs, such a force can be relatively great. This means that it is now possible to place, for example, a book in really all positions relative to the reader, even inverted above his head.

According to an advantageous embodiment of the invention, the hairs are directed in the opposite direction to that for detaching a sheet or page. This makes it simpler to add a page to a number of pages than to remove a page from them. The blocking effect with the hairs is reinforced in this way.

According to another advantageous embodiment of the invention, the hairs are disposed on a carrier, which carrier is then fixed to the support. In other words, parts with hairs can be removed from a larger sheet and fixed to the above mentioned supports.

Although the hairs, fixed on the carriers or otherwise, can comprise all hair types known in the prior art, it is preferable for the hairs to be brush hairs. Brush hairs are readily available and can be processed by conventional technology, and they are found to give the optimum result at a relatively low price.

In order also to be able to accommodate books and similar publications where there is a cover which has a greater spread than the measurement of the pages, according to an advantageous embodiment, a recess in which the cover can be accommodated is provided in the fixing device. This means that hardly any forces will be exerted on the cover, and the hairs can be fully effective on the pages of the publications in question.

According to a further advantageous embodiment of the invention, the contact face of the supports with the rear side of the publication is concave. Such a design is particularly important for relatively large, limp magazines.

It is also possible to provide the fixing device described above with illumination means.

BRIEF DESCRIPTION OF THE INVENTION

The invention will be explained in greater detail below with reference to examples of embodiments shown in the drawing, in which:

FIG. 1 shows a first embodiment of the fixing device according to the invention in side view, without a book in it;

FIG. 1*a* shows a detail of the device of FIG. 1;

DETAILED DESCRIPTION OF THE INVENTION

Figure 1:
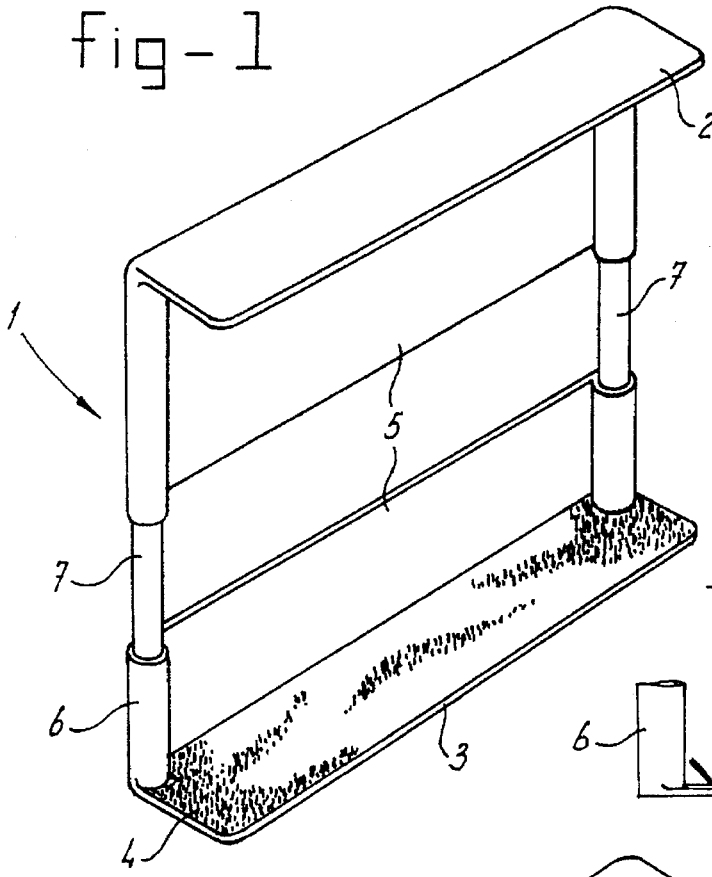
Figure 1A:
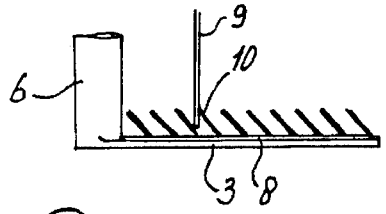

The fixing device according to the invention is shown in its entirety by 1 in FIG. 1. It comprises supports 2 and 3 on which deformable material 4 is provided, a detail of which is shown in FIG. 1*a*. The supports 2, 3 are provided with rear sides 5 and holders 6. Pins 7 are inserted into the holders 6. In FIG. 1 pin 7 is fixed to holder 6 of support 3 on the lefthand side, and is slidable in holder 6 of support 2, while the righthand side is made exactly the other way around. In this way the supports 2 and 3 are symmetrical and can be made, for example, in one piece by injection moulding.

FIG. 1*a* shows a detail of the deformable material 4. This deformable material 4 comprises a carrier 8, and fitted on it a large number of hairs 10 which face the rear side 5 of the support. FIG. 1*a* also shows schematically a page 9 of a book. It can be seen that page 9 is being held in place by the hairs 10. Disposing the hairs 10 at an angle ensures that it is easier to move page 9 to rear side 5 than back. This produces a positive locking. When the pages are turned the hairs will pivot essentially about the fixing point thereof.

Figure 2:
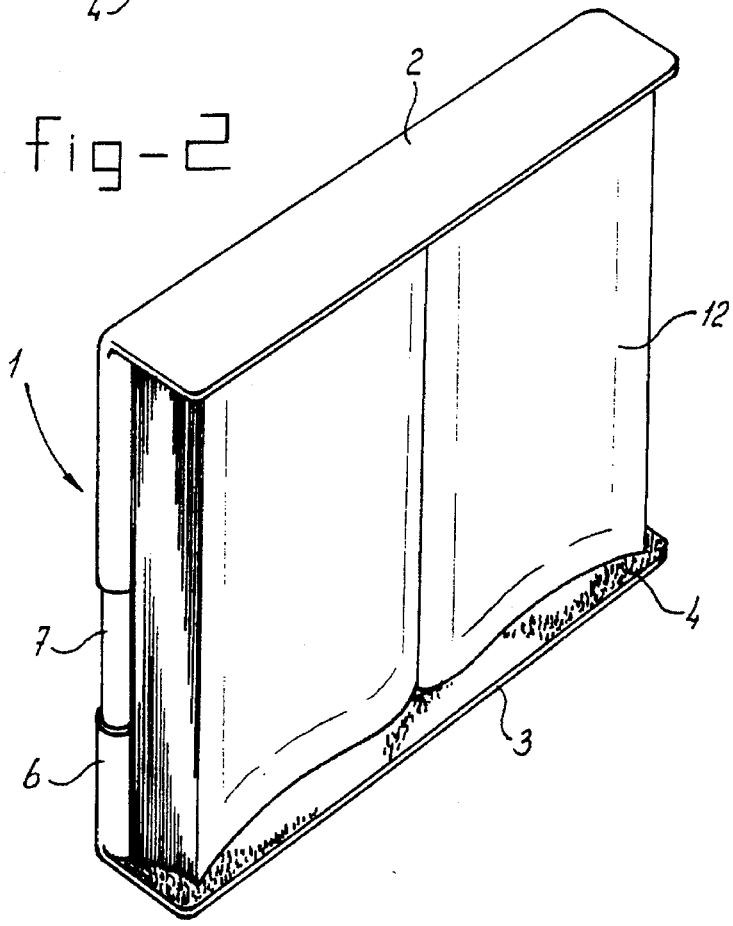
FIG. 2 shows the device according to FIG. 1 when the book is in it.

FIG. 2 shows the device according to FIG. 1 with a book 12 accommodated in it. Supports 2 and 3 are moved relative to each other in such a way that the deformable material 4 is holding the pages of the publication 12 on both sides.

Figure 3:
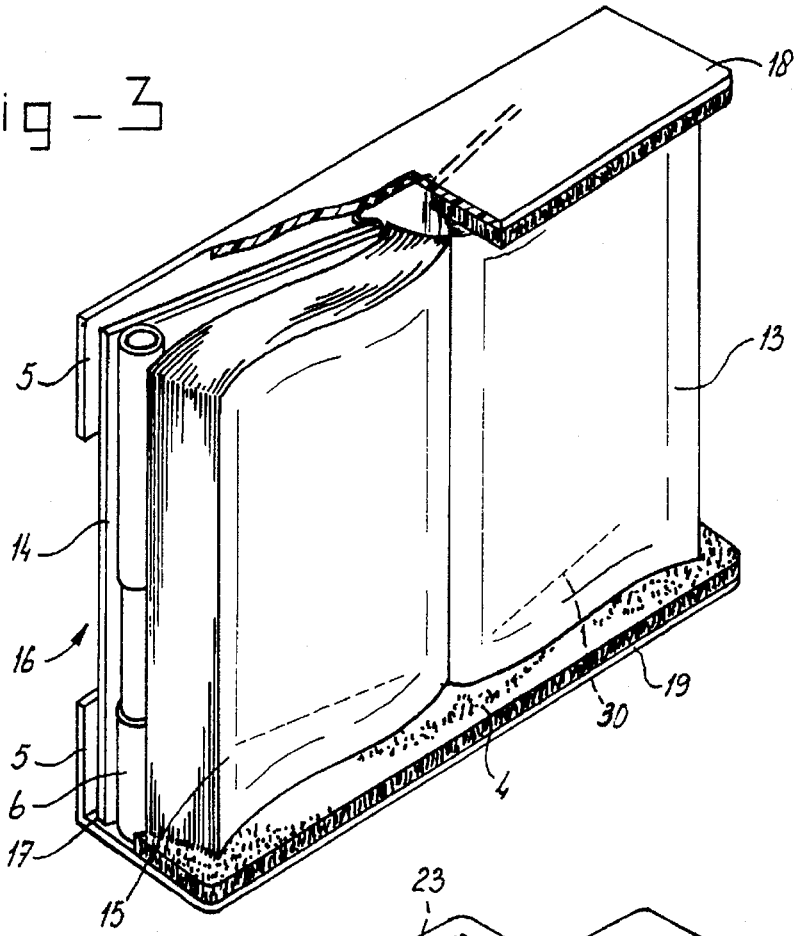
FIG. 3 shows a variant of an embodiment of the device according to FIG. 1.

If the publication is a book 13, as shown in FIG. 3, with a cover 14 which is slightly larger than the dimensions of the pages 15, it is necessary to take measures to prevent the book from being supported only on cover 14. In the case of the fixing element shown in FIG. 3, indicated in its entirety by 16, the deformable material 4 does not extend over the whole face of the supports. Moreover, the holders 6 are not fitted at the rear side 5, but at some distance from it. Since the deformable material is a certain thickness, in addition to the height of the hairs, a clear space 17 will consequently be produced behind the holder 6, for accommodation of the cover 14 of the publication concerned. This recess is designed here in such a way that when the supports 18 and 19 move towards each other the clamping force always acts at the position of the pages by means of the hairs described above. In addition, the use of the hairs with some length ensures that accurate positioning is less critical than in the prior art. As can be seen in particular from FIG. 1*a*, page 9 can be placed slightly deeper or slightly higher up relative to support 3, without it moving directly along hair 10. As shown by dashed lines 30 in FIG. 3, the surface area of the recess increases towards the centre of the book, in order to be able to accommodate the rather more bulky spine of the book.

Figure 4:
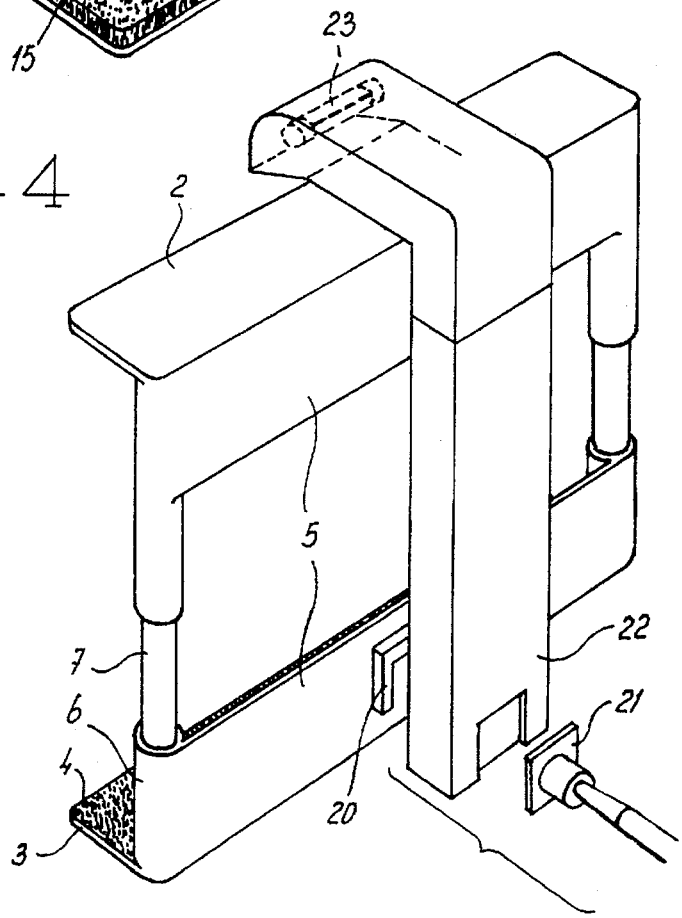
FIG. 4 shows the use of lighting means in the device according to FIG. 1.

FIG. 4 shows a further embodiment of the invention, which corresponds essentially to the embodiment shown in FIG. 1. Fixing means 20 are disposed at the rear side. Bearing means 21 of a stand or the like can be connected directly to it, but a lighting element 22 can be placed between them if desired. Such a lighting element can be provided with a battery (not shown) and a lamp 23.

Figure 5:
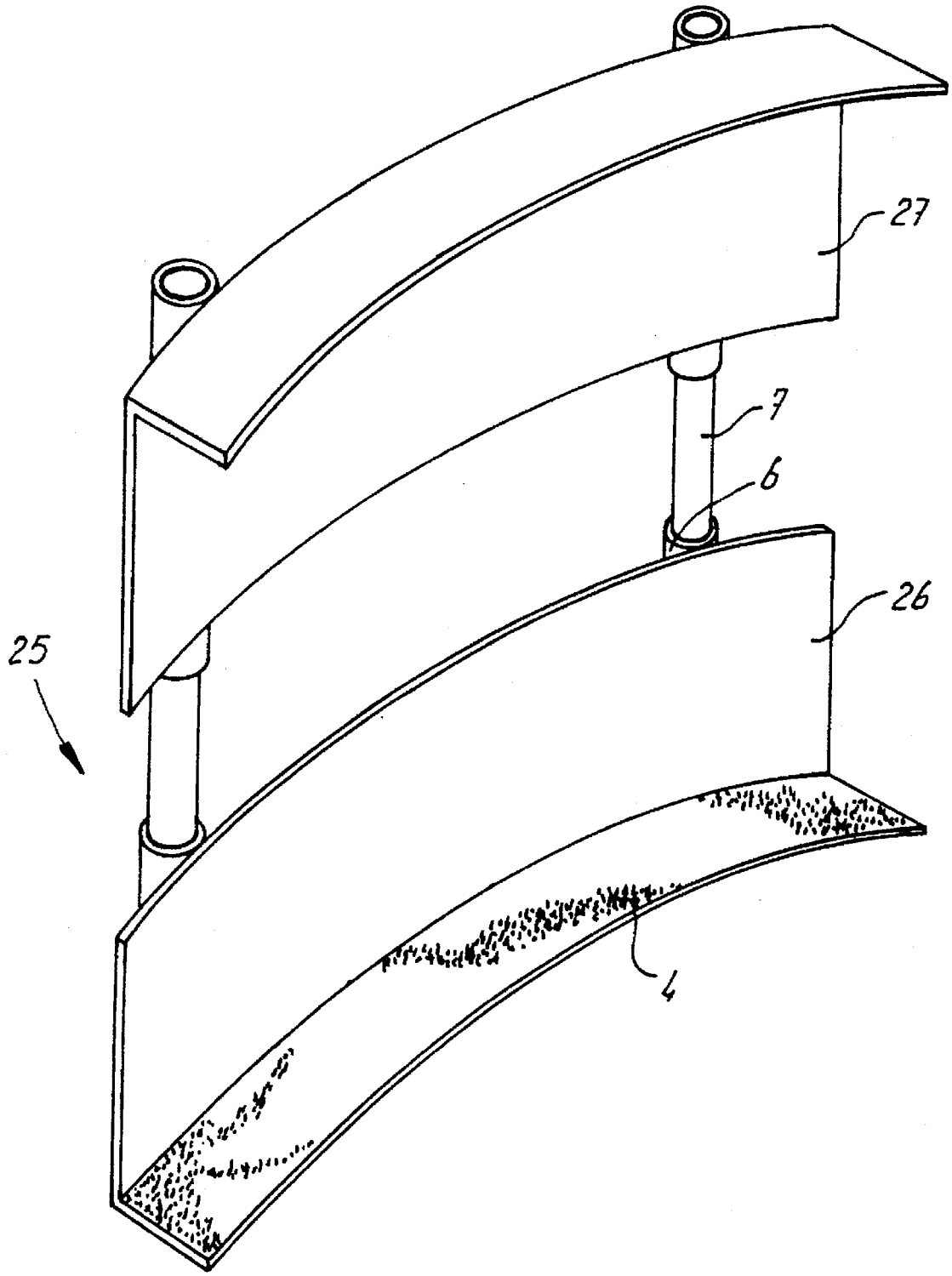
FIG. 5 shows a further embodiment according to the invention.

FIG. 5 shows a further embodiment of the invention, which is suitable in particular for large, limp magazines. This embodiment is indicated in its entirety by 25, and its supports by 26 and 27 respectively. Unlike the earlier embodiments, the supports are made curved, in order to place a certain tension on the magazine, so that it is held even better between the hairs of the deformable material 4.

In none of the above embodiments is it shown anywhere how the supports 2, 4; 18, 19 and 26, 27 are moved towards each other. This can be achieved with any spring device known in the prior art. Such a spring device can be fitted either in the holders 6, 7 or outside them.

Although the invention is described above with reference to a preferred embodiment, it must be understood that numerous modifications can be made to it without going beyond the scope of the invention, such as those for which rights are applied in the appended claims.

I claim:

1. A device for holding a publication such as a book or magazine, the device comprising two L-shaped supports slidably connected for sliding toward and away from each other, each of said supports being defined by a first leg connected to a second leg, said first legs of said supports having confronting surfaces between which said publication is adapted to be held, said confronting surfaces being covered with a material adapted to hold the edges of the pages of said publication, said material comprising a flat brush secured fixedly to each of said surfaces, each said brush having a plurality of upstanding hairs adapted to engage between pages of said publication to be held, said hairs being inclined relative to the surfaces from which they upstand, in a direction toward the associated said second leg, each said L-shaped support having opposite forwardly projecting end portions that position free edges of pages of the publication farther forward than bound edges of pages of the publication, a substantial portion of each said brush being disposed between said opposite end portions of the associated said L-shaped support.

2. The device according to claim 1, which further comprises two parallel telescopic guides having ends at which the supports are received.

3. The device according to claim 1, there being a recess for said cover of said publication, said recess being disposed behind said hairs.

4. The device according to claim 1, wherein said supports have concave forward surfaces.

5. The device according to claim 1, further comprising illumination means for said publication mounted on said device.

6. The device according to claim 1, wherein said L-shaped supports are identical to each other.

7. The device according to claim 1, wherein said first and second leg of each L-shaped support are at right angles to each other, said projecting end portions of said L-shaped supports being interengaging posts and sockets that are parallel to said second leg but spaced forwardly of said second leg to receive a cover of said publication between said second leg and said posts and sockets.

* * * * *